US006854454B2

(12) United States Patent
Obayashi et al.

(10) Patent No.: US 6,854,454 B2
(45) Date of Patent: Feb. 15, 2005

(54) OIL SEPARATING MECHANISM AND OIL SEPARATING UNIT

(75) Inventors: Noboru Obayashi, Hiroshima (JP); Tomohide Okuta, Hiroshima (JP); Nobuhiro Takamatsu, Hatsukaichi (JP); Fusatoshi Tanaka, Hiroshima-ken (JP); Megumu Fukushima, Hiroshima-ken (JP); Katsunori Kuremiya, Hiroshima-ken (JP); Akinori Gondai, Hiroshima-ken (JP)

(73) Assignees: Nifco Inc., Yokohama (JP); Mazda Motor Corporation, Hiroshima-ken (JP)

( * ) Notice: Subject to any disclaimer, the term of this patent is extended or adjusted under 35 U.S.C. 154(b) by 0 days.

(21) Appl. No.: 10/752,496

(22) Filed: Jan. 8, 2004

(65) Prior Publication Data

US 2004/0159313 A1 Aug. 19, 2004

(30) Foreign Application Priority Data

Feb. 17, 2003 (JP) ..... 2003-038059

(51) Int. Cl.[7] ..... F01M 13/04
(52) U.S. Cl. ..... 123/572; 123/573
(58) Field of Search ..... 123/572–574, 123/41.86

(56) References Cited

U.S. PATENT DOCUMENTS

| | | | | |
|---|---|---|---|---|
| 4,844,032 A | * | 7/1989 | Groeger et al. | 123/196 R |
| 5,474,035 A | * | 12/1995 | Ming et al. | 123/41.86 |
| 6,035,836 A | * | 3/2000 | Watanabe | 123/572 |
| 6,334,438 B1 | * | 1/2002 | Itoh et al. | 123/572 |
| 6,394,079 B2 | * | 5/2002 | Takada et al. | 123/572 |
| 6,412,478 B1 | * | 7/2002 | Ruehlow et al. | 123/572 |

FOREIGN PATENT DOCUMENTS

JP 63-109055 7/1988

* cited by examiner

*Primary Examiner*—Marguerite McMahon
(74) *Attorney, Agent, or Firm*—Manabu Kanesaka

(57) ABSTRACT

An oil separating mechanism to be attached to a cylinder block having a concave portion includes a cover member for forming a closed space; a partition wall for dividing the closed space into an inner chamber and an outer chamber; a dividing wall for dividing the inner chamber into a first inner chamber and a second inner chamber; a gas inlet for introducing gas into the first inner chamber; a gas outlet for discharging the gas; a first gas port for communicating the first inner chamber with the outer chamber; and a second gas port for communicating the outer chamber with the second inner chamber. The gas introduced into the first inner chamber flows from the first inner chamber to the outer chamber. Then, the gas flowing from the outer chamber to the second inner chamber is discharged through the gas outlet.

18 Claims, 12 Drawing Sheets

OIL SEPARATING MECHANISM AND OIL SEPARATING UNIT

BACKGROUND OF THE INVENTION AND RELATED ART STATEMENT

The present invention relates to an oil separating mechanism and an oil separating unit.

An oil separating mechanism is provided in a cylinder block having a concave portion opening outwardly at a sidewall thereof, and a cover member is attached to a peripheral edge of the concave portion to cover the same. The concave portion and the cover member form a closed space used for separating oil. As an example of a specific structure disposed in the closed space, Reference No. 1 has disclosed a structure in which a baffle plate is disposed in the closed space in a maze pattern. Reference No. 2 has disclosed a structure in which a partition wall having a communicating hole is provided in the closed space to divide the closed space into an outer chamber and an inner chamber. A baffle plate is provided in the inner chamber, and the outer chamber is provided with an opening-closing valve for allowing oil to flow in only from the inner chamber so that the outer chamber is used for housing the opening-closing valve.

Further, Reference No. 3 has disclosed a structure wherein a partition wall having a communicating hole is provided in the closed space to divide the closed space into an inner chamber and an outer chamber. The outer chamber is provided with an opening-closing valve for allowing oil to flow in only from the inner chamber, so that the outer chamber is used for housing the opening-closing valve. A pipe is provided at an opening portion of the communicating hole in the inner chamber.

According to the structures described above, blow-by-gas hits the baffle plate or the pipe to change a flow direction, so that oil mists contained in the blow-by-gas are separated.

Reference No. 1; Japanese Utility Model Publication (KOKOKU) No. 06-27778

Reference No. 2; Japanese Utility Model Publication (KOKAI) No. 57-182213

Reference No. 3; Japanese Patent Publication (KOKAI) No. 62-240413

In the oil separating mechanisms as described above, the process for separating the oil is a single step through either the baffle plate (Reference No. 1 and No. 2) or the pipe (Reference No. 3), so that it is difficult to achieve high separating performance.

In view of the above problems, the present invention has been made, and an object of the invention is to provide an oil separating mechanism with improved separating performance.

Another object of the invention is to provide an oil separating unit to be used for the oil separating mechanism.

Further objects and advantages of the invention will be apparent from the following description of the invention.

SUMMARY OF THE INVENTION order to attain the above-stated objects, according to an embodiment of the invention, an oil separating mechanism includes a cylinder block having a concave portion at a sidewall thereof, said concave portion having an opening outwardly; and a cover member attached to a peripheral edge of the concave portion for covering the opening so that a closed space is formed in the concave portion for separating oil. A partition wall is disposed in the closed space so that the closed space is divided into an inner chamber at an inner side in a width direction of the cylinder block and an outer chamber at an outer side in the width direction of the cylinder block. A dividing wall is disposed in the inner chamber and extends between the partition wall and a bottom of the concave portion so that the inner chamber is divided into a first inner chamber and a second inner chamber. A blow-by-gas inlet is provided in the first inner chamber for communicating with a crankcase. A blow-by-gas discharging port is provided in the second inner chamber. The partition wall is provided with a blow-by-gas inlet for communicating the first inner chamber with the outer chamber and a blow-by-gas vent for communicating the outer chamber with the second inner chamber.

According to another embodiment of the present invention, an oil separating unit covers the concave portion formed on the sidewall of the cylinder block for forming a closed space in the concave portion for separating oil. The oil separating unit includes a cover member having a concave portion therein so that the closed space expands toward outside in a width direction of the cylinder block when the cover member is attached to a peripheral edge of the concave portion of the cylinder block; a partition wall disposed in the concave portion inside the cover member for dividing the closed space into an inner chamber at an inner side in the width direction of the cylinder block and an outer chamber at an outer side in the width direction of the cylinder block when the cover member is attached to the peripheral edge of the concave portion; a dividing wall integrated with the partition wall and abutting against a component in the concave portion when the cover member is attached to the peripheral edge of the concave portion so that the inner chamber is divided into a first inner chamber communicating with a crankcase and a second inner chamber having a blow-by-gas discharging port; a blow-by-gas inlet formed in the partition wall for allowing the first inner chamber to communicate with the outer chamber; and a blow-by-gas vent formed in the partition wall for allowing the outer chamber to communicate with the second inner chamber.

In the first aspect of the invention, the blow-by-gas hits an inner wall of the first inner chamber to change a flow direction. Oil mists contained in the blow-by-gas do not follow the blow-by-gas or become large through agglomeration, and are separated from the blow-by-gas. While the blow-by-gas flows to the blow-by-gas inlet, the oil mists fall due to the gravitation and are separated from the blow-by-gas. After the blow-by-gas is introduced into the outer chamber, the gas is cooled down in the outer chamber through the cover member until the gas reaches the blow-by-gas vent. Accordingly, the agglomeration of the oil mists is accelerated, and the oil mists are further separated from the blow-by-gas.

When the blow-by-gas is discharged to the second inner chamber from the outer chamber through the blow-by-gas vent, the blow-by-gas slows down due to the chamber (space) effect, and the oil mists are further separated from the blow-by-gas through the gravitation. Therefore, the oil separating mechanism includes the three processing areas for separating the oil in a limited space such as the sidewall of the cylinder block, thereby improving separating performance effectively.

In the second aspect of the invention, the cover member may be formed of a curved plate to increase a cooling area as compared with a flat plate, thereby increasing cooling performance of the outer chamber. Accordingly, the separating performance due to the cooling in the outer chamber can be improved.

In the third aspect of the invention, the cover member expands toward the outside in the width direction of the cylinder block, and includes the concave portion therein. The partition wall is disposed in the concave portion of the cover member. The outer chamber is formed inside the cover member. The outer chamber is formed in a flat shape with a thin thickness in the width direction (thickness direction of the cover member) of the cylinder block, and is elongated in the longitudinal direction of the cylinder block. Accordingly, it is possible to effectively cool the blow-by-gas flowing in the flat outer chamber from the blow-by-gas inlet to the blow-by-gas vent, thereby accelerating the agglomeration of the oil mists. The oil mists become dense in the flat outer chamber, thereby further accelerating the agglomeration of the oil mists. It is possible to extend the first and second inner chambers in the width direction of the cylinder block, thereby facilitating the separation of the oil mists through the gravitation.

In the fourth aspect of the invention, the partition wall and the cover member may be formed in wave shapes so that the space of the outer chamber formed by the partition wall and the cover member has a meandering shape extending from the blow-by-gas inlet to the blow-by-gas vent. Accordingly, the oil mists easily stick to the inner surfaces of the partition wall and the cover member. As a result, the inner surfaces of the partition wall and the cover member become wet due to the oil mists, thereby further facilitating the sticking of the oil mists contained in the blow-by-gas. Moreover, similar to the baffle plate, the meandering shape of the space of the outer chamber accelerates the agglomeration and separation of the oil mists.

In the fifth aspect of the invention, the first inner chamber is arranged under the second inner chamber, and the blow-by-gas inlet is arranged under the blow-by-gas vent. Accordingly, the oil mists agglomerated as the oil flow down along the inner surfaces of the partition wall and the cover member. Therefore, it is easy to collect the oil, and large portions of the inner surfaces of the partition wall and the cover member become wet, thereby facilitating the sticking of the oil mists.

In the sixth aspect of the invention, the blow-by-gas inlet may be formed in a portion of the partition wall projecting toward outside in the width direction of the cylinder block with increasing an amount of the projection downwardly. Accordingly, it is possible to properly guide the oil into the blow-by-gas inlet, so that the blow-by-gas inlet can be used for collecting the oil as well as for guiding the blow-by-gas into the outer chamber.

In the seventh aspect of the invention, the partition wall may be disposed in the cover member at one side in the longitudinal direction of the cylinder block. The outer chamber is disposed in the cover member at the one side in the longitudinal direction of the cylinder block. The blow-by-gas discharging port is formed at an upper portion of the cover member at the other side in the longitudinal direction of the cylinder block. Accordingly, the blow-by-gas discharge port is formed in the cover member instead of the cylinder block, thereby reducing load for machining the cylinder block.

In the eighth aspect of the invention, the partition wall is disposed in the cover member at the one side in the longitudinal direction of the cylinder block, and may become narrower upwardly in the longitudinal direction of the cylinder block. The outer chamber may become narrower upwardly in the longitudinal direction of the cylinder block. Accordingly, the oil mist becomes dense upwardly, thereby facilitating the agglomeration of the oil mists and improving the separating performance of the oil.

In the ninth aspect of the invention, an oil discharging port may be formed in the partition wall at a lower side of the dividing wall. A cylindrical member is provided at a peripheral edge of the oil discharging port, and extends toward inside the concave portion of the cylinder block. Similar to the Borda's mouthpiece, the cylindrical member increases a degree of contraction of the gas flow into the outer chamber to thereby increase the loss head. As a result, the blow-by-gas is introduced into the outer chamber through the blow-by-gas inlet more than the oil discharging port. It is possible to prevent the oil discharging port from being clogged by blowing-up of the oil.

In the tenth aspect of the invention, the oil discharging port may be formed in a portion of the partition wall projecting toward outside in the width direction of the cylinder block with increasing an amount of the projection downwardly. Accordingly, it is possible to guide the oil into the oil discharging port, so that the oil discharging port is properly used for collecting the oil.

In the eleventh aspect of the invention, the blow-by-gas inlet is formed in the first inner chamber at a lower side thereof. Accordingly, the blow-by-gas entered from the crankcase securely hits the dividing wall to change the flow direction. Therefore, it is possible to securely separate the oil mists in the first inner chamber.

In the twelfth aspect of the invention, the blow-by-gas inlet may be formed in the outer chamber at a position away from a bottom surface thereof. Accordingly, it is possible to collect the oil up to a position of the blow-by-gas inlet, so that the blow-by-gas introduced from the blow-by-gas inlet contacts the oil in a manner of liquid-gas contact. Therefore, it is possible to collect the oil mists contained in the blow-by-gas during the introduction of the blow-by-gas into the outer chamber.

In the thirteenth aspect of the invention, the blow-by-gas inlet may be formed of a long hole with a long axis thereof arranged horizontally. Accordingly, it is possible to increase a gas-liquid contacting surface between the blow-by-gas and the oil, thereby increasing the collection of the oil mists through the sticking (agglomeration).

In the fourteenth aspect of the invention, the dividing wall may be inclined such that one side thereof in the longitudinal direction of the cylinder block is lower than the other side. A drain hole may be formed in the dividing wall at the one side thereof in the longitudinal direction of the cylinder block for allowing the first inner chamber to communicate with the second inner chamber. Accordingly, the oil separated in the second inner chamber is introduced into the drain hole along the dividing wall, and returns to the crankcase through the first inner chamber.

In the fifteenth aspect of the invention, the cover member expands toward outside in the width direction of the cylinder block, and includes the concave portion therein. The partition wall is disposed in the concave portion of the cover member. The outer chamber is disposed in the cover member. The dividing wall includes one dividing wall portion extending from the bottom of the concave portion of the cylinder block and the other dividing wall portion extending from the partition wall and abutting against the one dividing wall. Accordingly, the bottom of the concave portion and the partition wall need to support only the respective dividing wall portions. Also, when the cover member is attached to the peripheral edge of the concave portion, the dividing wall is automatically obtained.

In the sixteenth aspect of the invention, it is possible to obtain advantages same as described in the eleventh, seventh, ninth, sixth, tenth and fifteenth aspects, thereby providing a preferable oil separating mechanism.

In the seventeenth aspect of the invention, when the oil separating unit is attached to the peripheral edge of the concave portion of the cylinder block, the oil separating mechanisms in the first and third aspects are obtained through the oil separating unit.

In the eighteenth aspect of the invention, the partition wall and the cover member may be formed in a wave shape so that the space of the outer chamber formed by the partition wall and the cover member has a meandering shape extending from the blow-by-gas inlet to the blow-by-gas vent. Accordingly, it is possible to obtain an advantage same as that in the fourth aspect.

In the nineteenth aspect of the invention, the first inner chamber is arranged under the second inner chamber, and the blow-by-gas inlet is arranged under the blow-by-gas vent. Accordingly, it is possible to obtain an advantage same as that in the fifth aspect.

In the twentieth aspect of the invention, the blow-by-gas inlet may be formed in a portion of the partition wall projecting toward outside in the width direction of the cylinder block with increasing an amount of the projection downwardly. Accordingly, it is possible to obtain an advantage same as that in the sixth aspect.

In the twenty-first aspect of the invention, the partition wall may be disposed in the cover member at one side in the longitudinal direction of the cylinder block. The outer chamber may also be disposed in the cover member at the one side in the longitudinal direction of the cylinder block. The blow-by-gas discharging port is formed at an upper portion of the cover member at the other side in the longitudinal direction of the cylinder block. Accordingly, it is possible to obtain an advantage same as that in the seventh aspect.

In the twenty-second aspect of the invention, the partition wall is disposed in the cover member at the one side in the longitudinal direction of the cylinder block, and may become narrower upwardly in the longitudinal direction of the cylinder block. The outer chamber becomes narrower upwardly in the longitudinal direction of the cylinder block. Accordingly, it is possible to obtain an advantage same as that in the eighth aspect.

In the twenty-third aspect of the invention, an oil discharging port may be formed in the partition wall at a lower side of the dividing wall. A cylindrical member is provided at a peripheral edge of the oil discharging port, and extends toward inside the concave portion of the cylinder block. Accordingly, it is possible to obtain an advantage same as that in the ninth aspect.

In the twenty-fourth aspect of the invention, the oil discharging port may be formed in a portion of the partition wall projecting toward outside in the width direction of the cylinder block with increasing an amount of the projection downwardly. Accordingly, it is possible to obtain an advantage same as that in the tenth aspect.

In the twenty-fifth aspect of the invention, the blow-by-gas inlet may be formed in the outer chamber at a position apart from a bottom surface thereof. Accordingly, it is possible to obtain an advantage same as that in the twelfth aspect.

In the twenty-sixth aspect of the invention, the blow-by-gas inlet may be formed of a long hole with a long axis thereof arranged horizontally. Accordingly, it is possible to obtain an advantage same as that in the thirteenth aspect.

In the twenty-seventh aspect of the invention, the dividing wall may be inclined such that one side thereof in the longitudinal direction of the cylinder block is lower than the other side. A drain hole may be formed in the dividing wall at the one side thereof in the longitudinal direction of the cylinder block for allowing the first inner chamber to communicate with the second inner chamber. Accordingly, it is possible to obtain an advantage same as that in the fourteenth aspect.

In the twenty-eighth aspect, the dividing wall is to be housed in the concave portion of the cover member. Accordingly, it is easy to attach and handle the oil separating unit.

In the twenty-ninth aspect of the invention, the blow-by-gas discharging port is formed at the upper portion of the cover member at the other side thereof in the longitudinal direction of the cylinder block. The oil discharging port is formed in the partition wall at the lower side of the dividing wall. The cylindrical member extending toward inside the concave portion of the cylinder block is provided at the peripheral edge of the oil discharge port. The blow-by-gas discharging port is formed in the cover member not in the cylinder block to thereby reduce the workload for machining the cylinder block. Further, it is possible to guide the blow-by-gas into the outer chamber through the blow-by-gas inlet more than through the oil discharging port. Also, it is possible to prevent the oil discharging port from being clogged by the oil blowing-up.

In the thirtieth aspect of the invention, the blow-by-gas inlet and the oil discharging port are arranged side by side at portions apart from the bottom surface of the outer chamber. Accordingly, it is possible to collect the oil in the outer chamber up to the positions of the blow-by-gas inlet and the oil discharging port, so that the blow-by-gas introduced through the blow-by-gas inlet contacts the oil in a manner of gas-liquid contact. As a result, it is possible to collect the oil mists contained in the blow-by-gas through the sticking (agglomeration) during the introduction of the blow-by-gas into the outer chamber.

In the thirty-first aspect of the invention, the blow-by-gas inlet is formed of a long hole with the long axis thereof arranged horizontally. Accordingly, it is possible to increase the gas-liquid contacting surface between the blow-by-gas and the oil, thereby facilitating the collection of the oil mists through the sticking (agglomeration).

DESCRIPTION OF PREFERRED EMBODIMENTS

Figure 1:
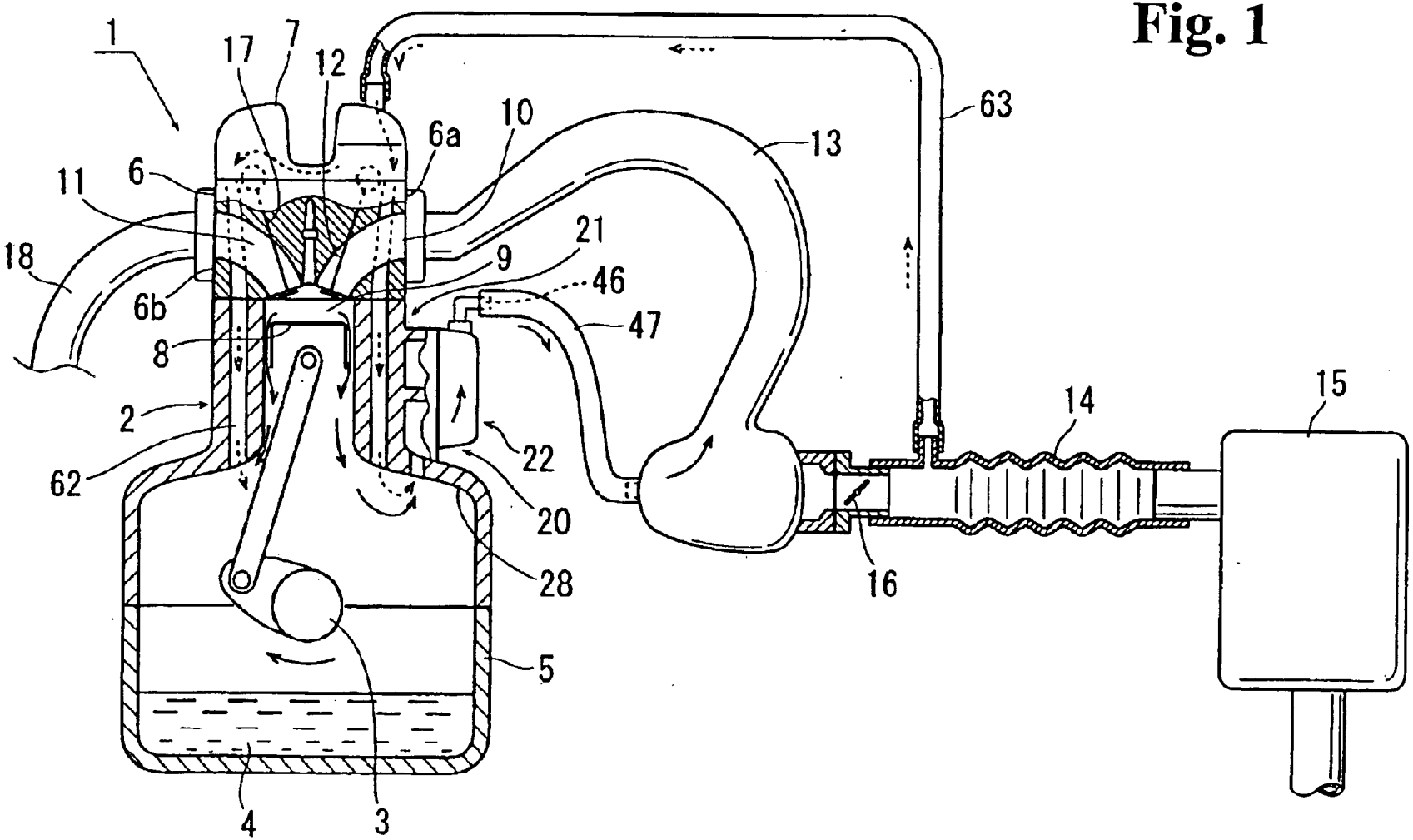
FIG. 1 is an explanatory view showing an engine main portion to which an oil separating mechanism is applied according to an embodiment of the invention.
Figure 2:
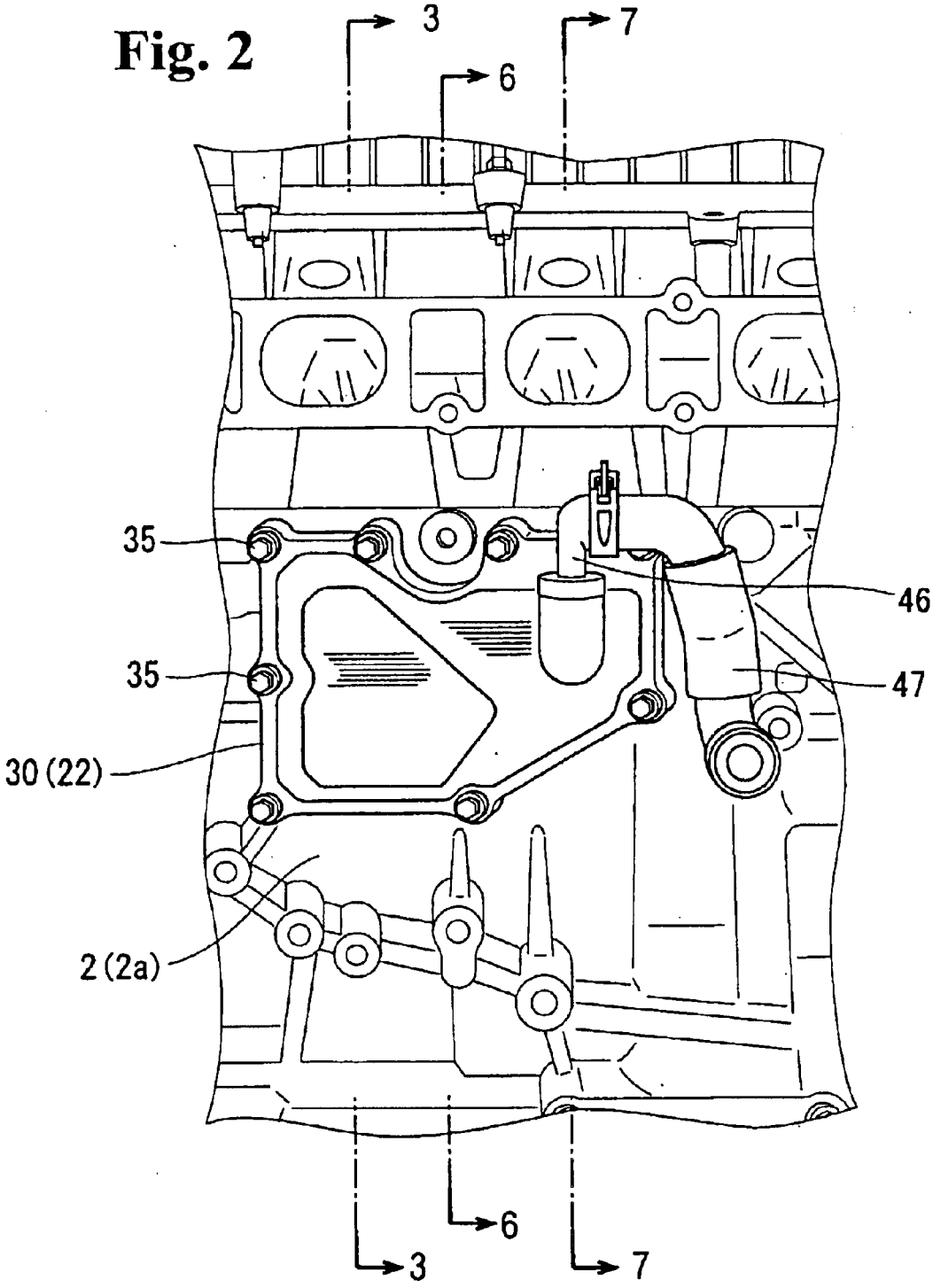
FIG. 2 is a partial perspective view showing an oil separating unit attached to a sidewall of a cylinder block according to the embodiment of the invention.

Hereunder, embodiments of the invention will be explained with reference to the drawings. In FIG. 1, reference numeral 1 represents an engine main portion. In the engine main portion 1, as already known, a crankcase 5 (including oil pan) is disposed under a cylinder block 2 for housing a crank shaft 3, oil 4 and the like. A cylinder head cover 7 is attached to an upper portion of the cylinder block 2 through a cylinder head 6. A combustion chamber 9 is defined by the cylinder head 6, the cylinder block 2 and a piston 8 fitted in a cylinder of the cylinder block 2. The cylinder head 6 includes an inlet 10 and an exhaust port 11. One end of the inlet 10 is opened in the combustion chamber 9, and the other end thereof is opened outside from one sidewall 6*a* of the cylinder head 6.

While one end of the inlet 10 is opened or closed with a predetermined timing by an inlet valve 12, the other end thereof is connected to an inlet pipe 14 through an inlet manifold 13. The inlet pipe 14 is provided with an air cleaner 15, a throttle valve 16 and the like from an upstream side to a downstream side in this order. One end of the exhaust port 11 is opened in the combustion chamber 9 and the other end thereof is opened outside from the other sidewall 6*b* of the cylinder head 6. While one end of the exhaust port 11 is closed or opened at a predetermined timing by an exhaust valve 17, the other end of the exhaust port 11 is connected to the exhaust manifold (exhaust pipe) 18.

In the engine main portion 1 as described above, as shown in FIG. 1, an oil separating portion 20 constituting an oil separating mechanism is attached to a sidewall 2*a* of the cylinder block 2. As shown by solid lines with arrows in FIG. 1, blow-by-gas (combustion gas) flows from the combustion chamber 9 into the crankcase 5 through a space between a piston 8 and an inner wall (in cylinder block 2) of a cylinder into which the piston 8 is inserted. The blow-by-gas inevitably contains oil mists, and the oil separating portion 20 has a function for separating the oil mists contained in the blow-by-gas and for returning only the blow-by-gas to an inlet system as gas. In order to obtain the function, the oil separating portion 20 includes an oil separating unit attaching structure portion 21 provided on the sidewall 2*a* of the cylinder block 2, and an oil separating unit 22 is attached to the oil separating unit attaching structure portion 21.

Figure 3:
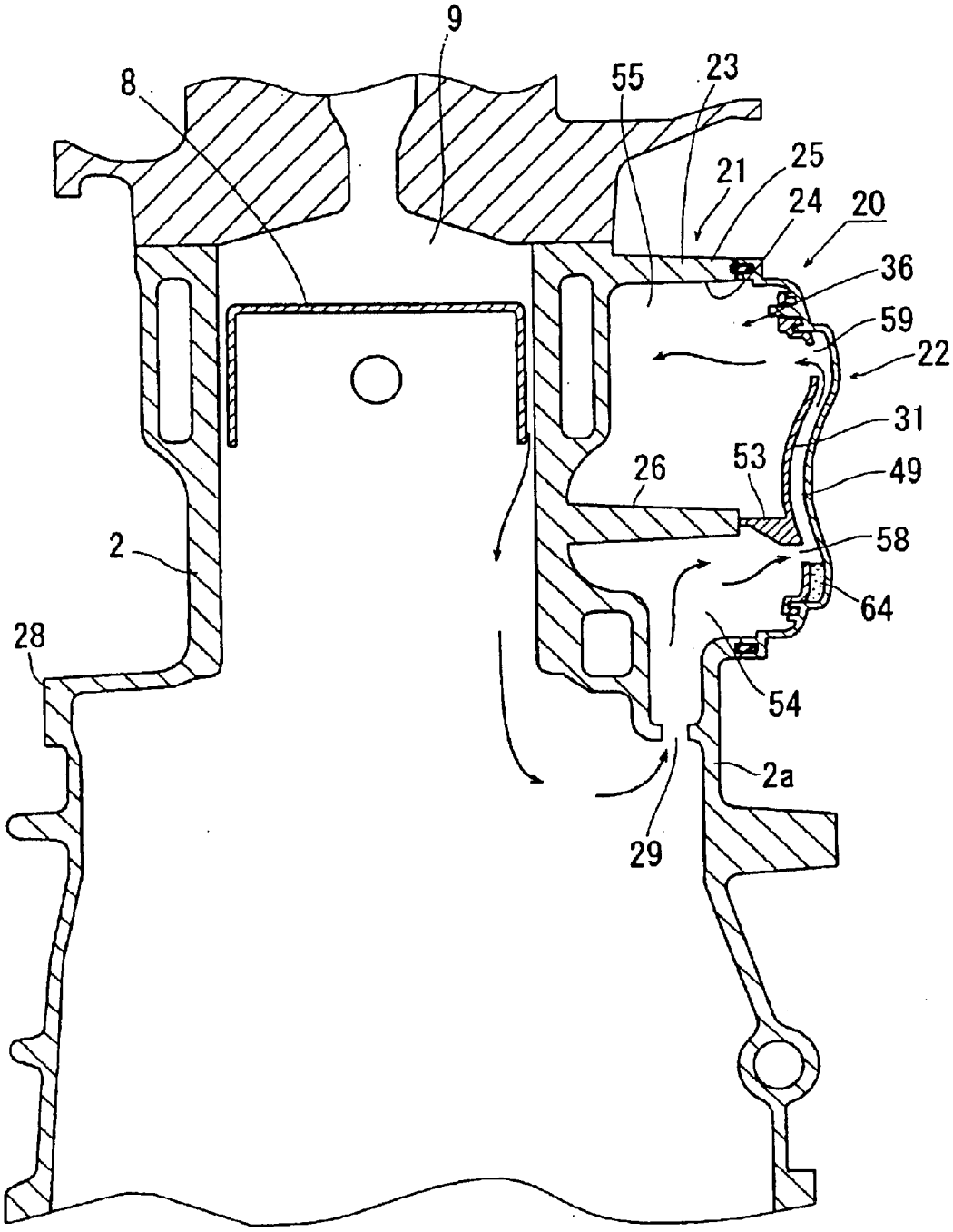
FIG. 3 is an enlarged sectional view taken along line 3—3 in FIG. 2.
Figure 4:
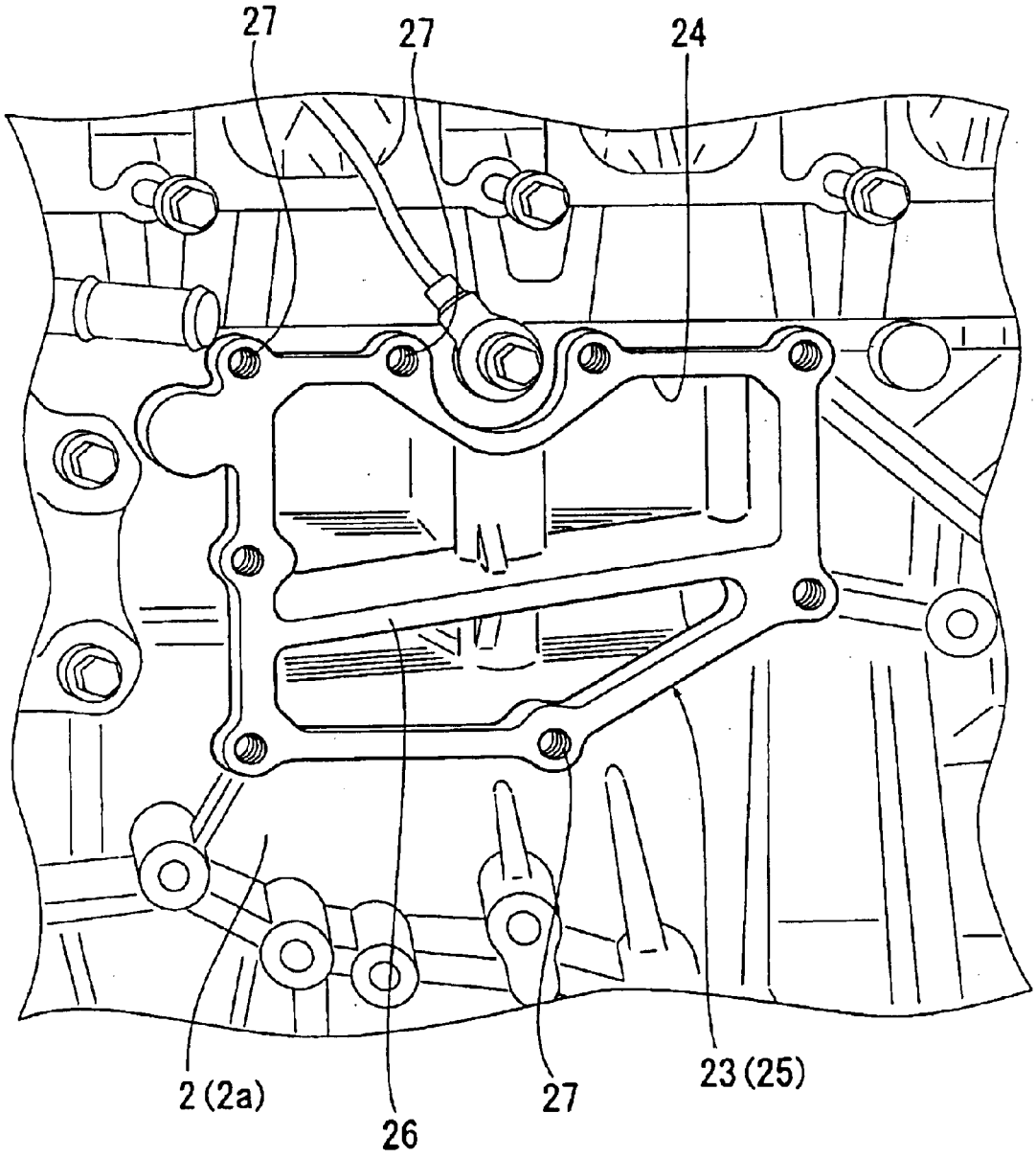
FIG. 4 is a perspective view showing an attaching structure of an oil separator of the embodiment.

As shown in FIGS. 3 and 4, the oil separating unit attaching structure portion 21 includes a concave portion 24 formed by a frame member 23 (concave peripheral edge) on the sidewall 2*a* of the cylinder block 2. The frame member 23 is formed of a peripheral wall portion 25 projecting to divide the concave portion 24 and a partition wall portion 26 projecting inside the peripheral wall portion 25. The peripheral wall portion 25 has a space therein and a plurality of bolt attaching holes 27 at a forward end surface thereof.

The partition wall portion 26 is disposed for dividing the interior of the concave portion 24 vertically into two chambers. While a forward end surface of the partition wall portion 26 aligns with the forward end surface of the peripheral wall portion 25 at the same projecting position (in the aligned surface state), one end side (left side in FIG. 4) of the partition wall portion 26 in the longitudinal direction of the cylinder block is inclined to be lower than the other end side (right side in FIG. 4) in the longitudinal direction of the cylinder block. Moreover, the upper surface thereof is inclined to be slightly lower toward outside in the width direction (horizontal direction in FIG. 3) of the cylinder block.

The frame member 23 is provided on a skirt portion 28 to utilize a structure of the skirt portion 28 expanding outwardly in the width direction of the cylinder block 2. A blow-by-gas inlet 29 is formed at a lower portion of the frame member 23, and communicates a lower chamber of the two chambers with the crankcase 5.

As shown in FIGS. 2, 3, 5 through 9, the oil separating unit 22 includes a cover member 30 and a partition wall plate 31 as a partition wall. In the present embodiment, these members are formed of a material with good rigidity, dimensional stability (presence of cracks when a bolt is tightened), heat resistance (deformation under a maximum temperature of 130° C.), oil resistance, gasoline resistance, calcium chloride resistance (presence of deterioration) and the like. Specifically, glass filled polyamide 66 (PA66) and the like are used.

Figure 8:
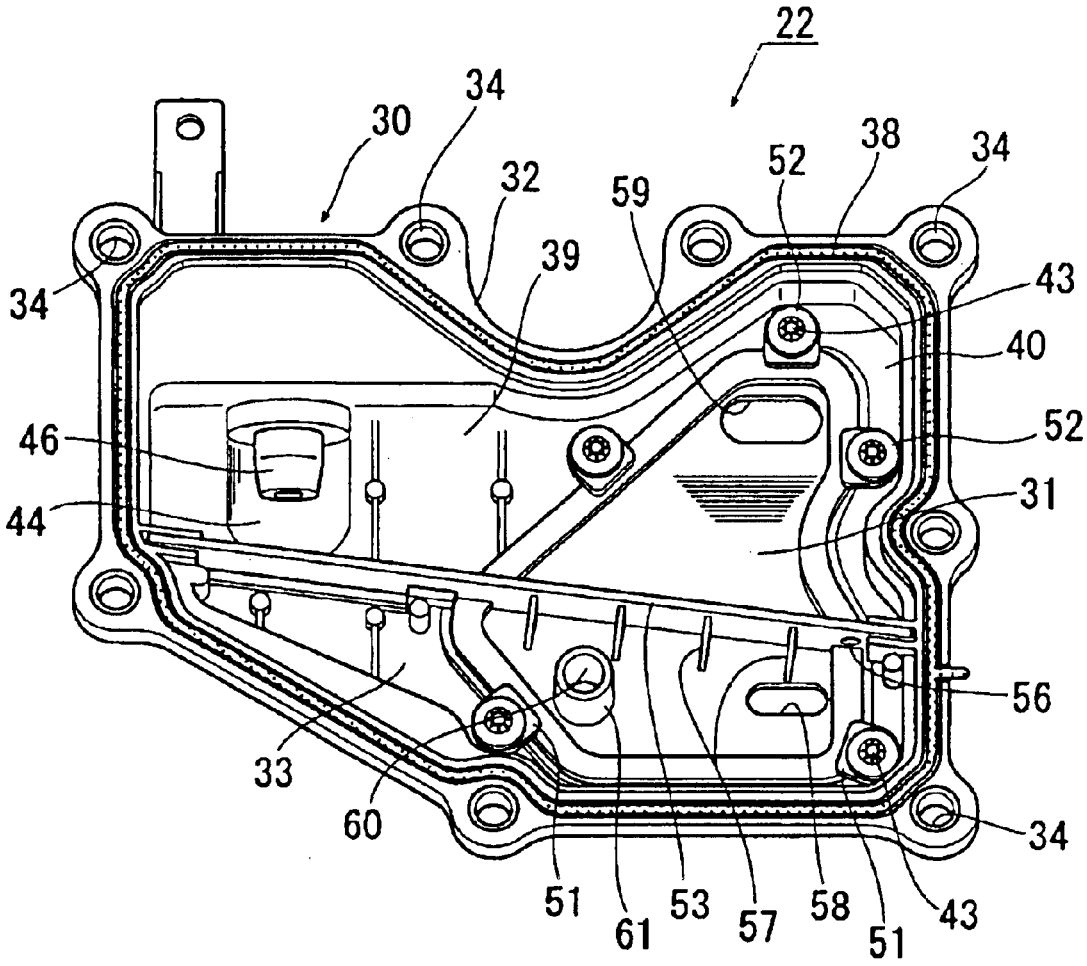
FIG. 8 is a view showing an inner surface of the oil separating unit of the embodiment.
Figure 9:
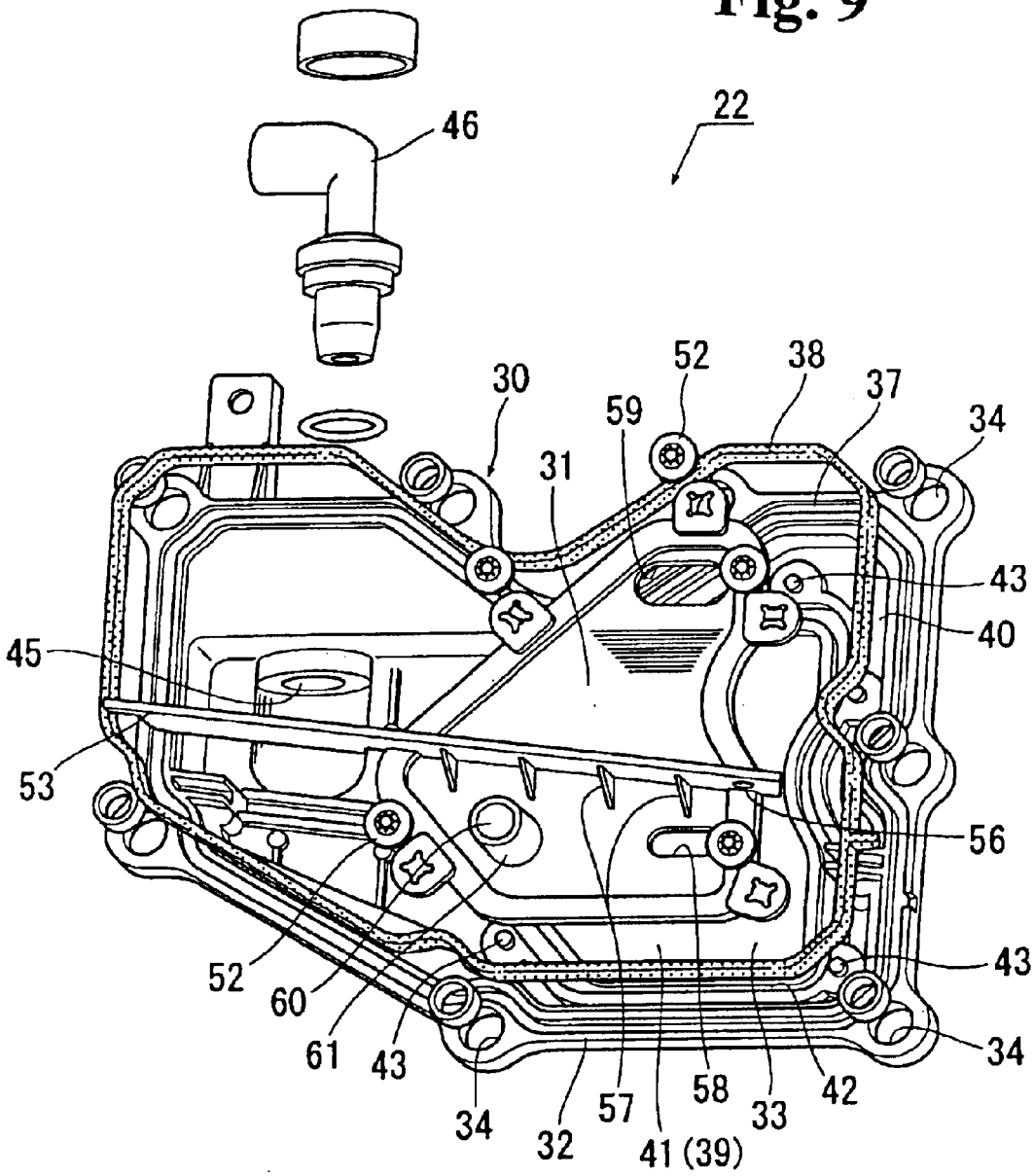
FIG. 9 is an explanatory view showing an attached state of the oil separating unit of the embodiment.

As shown in FIGS. 8 and 9, a shape of the outer peripheral edge of the cover member 30 corresponds to the peripheral wall portion 25. A flange portion 32 is formed at the peripheral edge of the cover member 30 to be attached to the forward end surface of the peripheral wall portion 25. An outer wall portion 33 is formed in a shape extending toward inside the flange portion 32. A plurality of bolt inserting holes 34 corresponding to a plurality of bolt attaching holes 27 on the peripheral wall portion 25 is provided on the flange portion 32.

Figure 5:
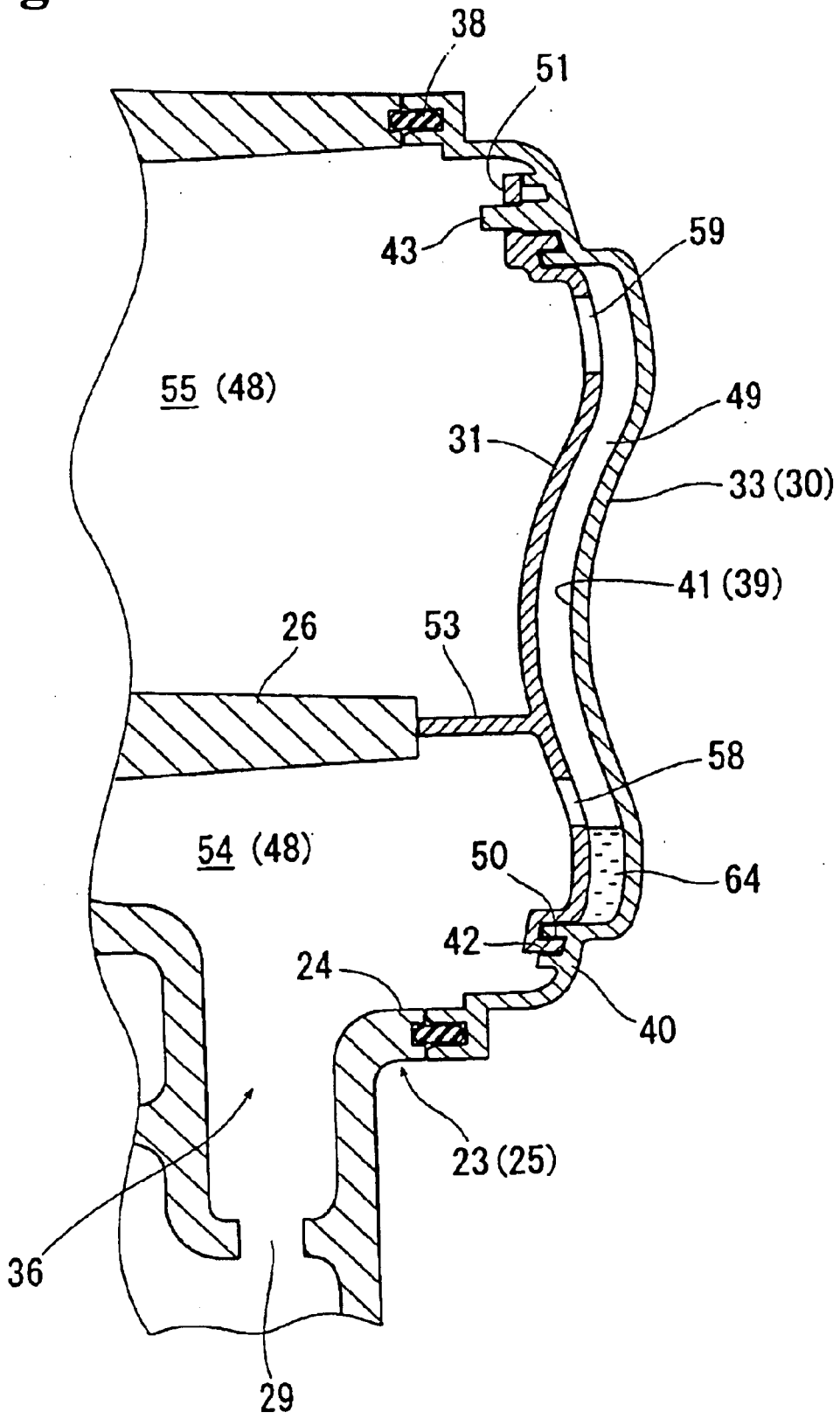
FIG. 5 is an enlarged view of an essential part shown in FIG. 3.

The cover member 30 is attached to an end surface of the frame member 23 by screwing bolts 35 into the respective bolt attaching holes 27 through the respective bolt insertion holes 34, so that the frame member 23 and the cover member 30 form a closed space 36 (see FIGS. 3 and 5). A seal attaching groove 37 is formed in the inner surface of the flange portion 32 over the whole periphery inside the respective bolt insertion holes 34, and a seal 38 is fit into the seal attaching groove 37. The cover member 30 is attached to the frame member 23 by the respective bolts 35. Accordingly, the seal 38 is pressed against the forward end surface of the peripheral wall portion 25, so that air tightness of the closed space 36 can be secured with respect to the outside.

As shown in FIGS. 8 and 9, the outer wall portion 33 extends outwardly from the whole periphery of the flange portion 32 to form a concave portion 39 therein. One half area of the concave portion 39 (right side in FIG. 8) in the lateral direction of the cover member 30 (horizontal direction in FIG. 8) has a staircase shape with two steps. A step portion 40 divides the lowest concave portion 41 in the concave portion 39. In the present embodiment, a lower portion of the lowest concave portion 41 extends as much as possible at one side of the cover member 30 in the lateral direction. An upper portion of the lowest concave portion 41 has a lateral width gradually decreasing upwardly. A groove 42 to be attached to the whole periphery is formed in the step portion 40, and a plurality of attaching projections 43 is provided on an outer peripheral side of the attaching groove 42.

Figure 6:
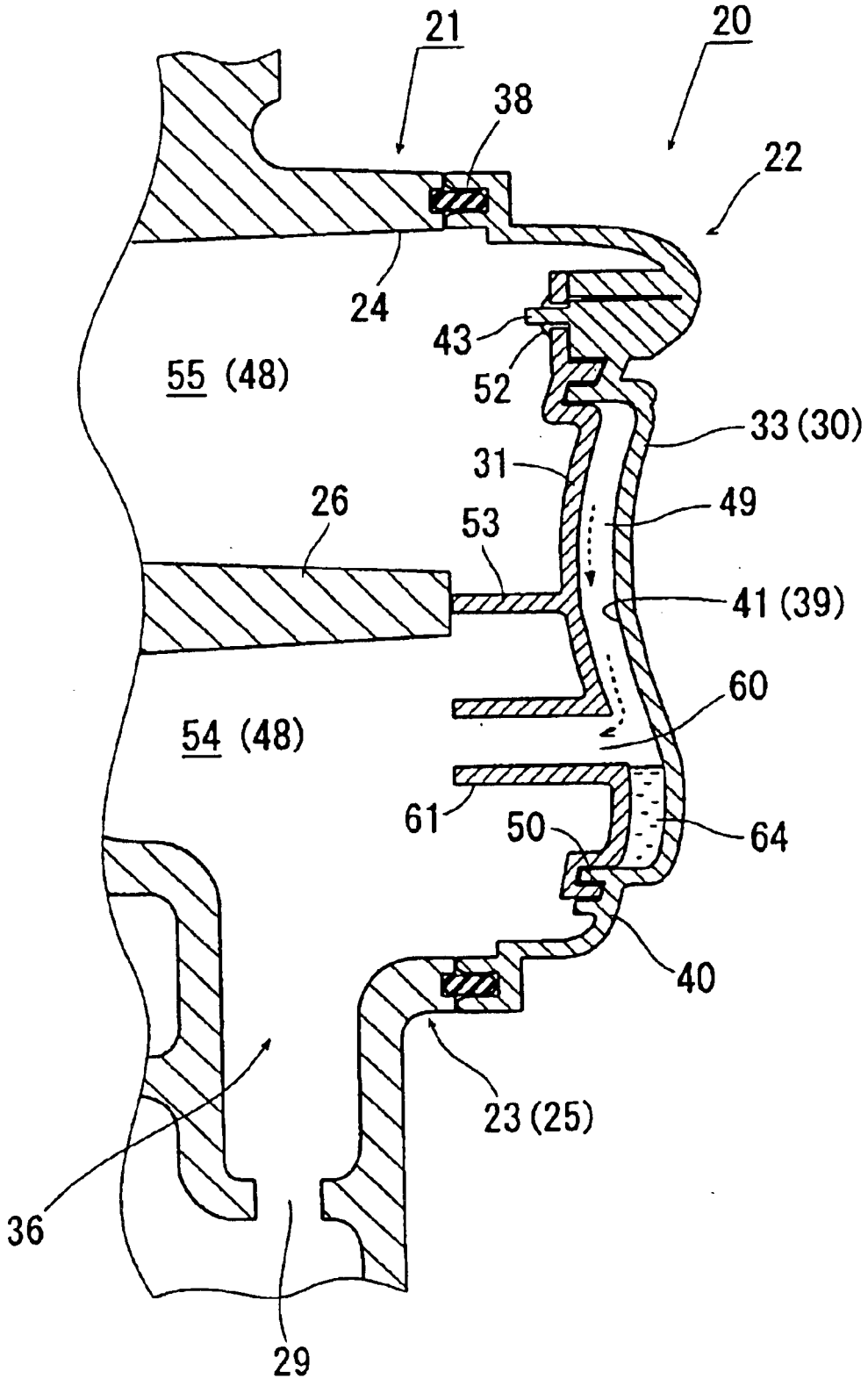
FIG. 6 is an enlarged sectional view taken along line 6—6 in FIG. 2.

As shown in FIGS. 3, 5 and 6, the outer wall portion 33 is formed in a curved wave shape. In a state that the cover member 30 is attached to the frame member 23, a lower portion of the outer wall portion 33 relative to the partition wall portion 26 is curved toward inside (left direction in FIG. 5) of the frame member 23 in the cylinder block 2 from a lower side to an upper side in the width direction of the cylinder block 2. An upper side of the outer wall portion 33 above the partition wall portion 26 is curved toward outside (right direction in FIG. 5) in the width direction of the cylinder block 2. Accordingly, the outer wall portion 33 has a larger area (cooling area) as compared with a flat plate type outer wall portion.

Figure 7:
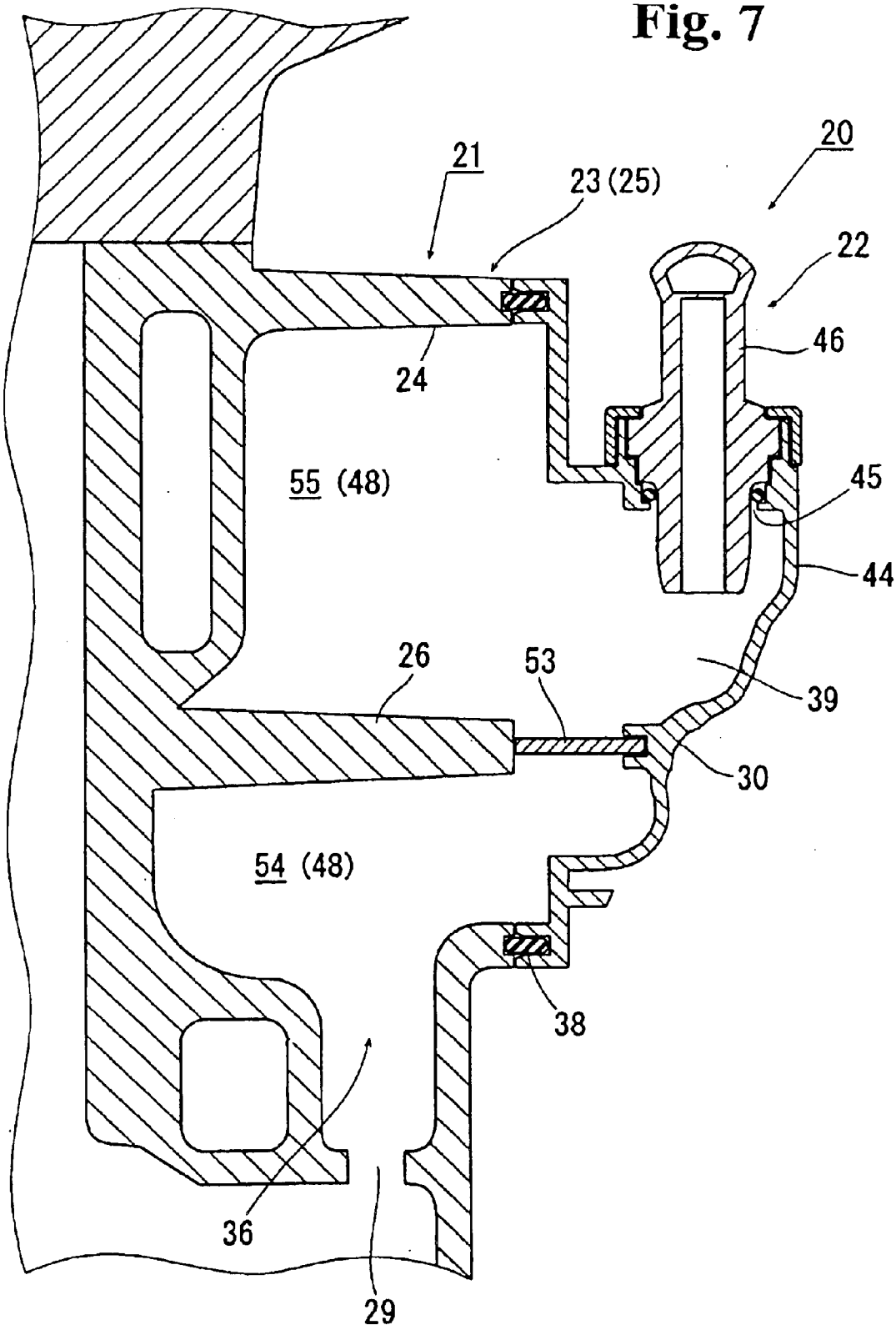
FIG. 7 is an enlarged sectional view taken along line 7—7 in FIG. 2.

On the other hand, as shown in FIG. 7, the outer wall portion 33 is provided with a swollen portion 44, and a blow-by-gas discharging port 45 is formed to the swollen portion 44. The swollen portion 44 is formed by expanding the upper portion of the cover member 30 toward the outer side (outer direction in the width direction of the cylinder block) in the thickness direction thereof on the other side (left side in the drawing) in the lateral direction of the cover member 30. The blow-by-gas discharging port 45 vertically penetrates through the swollen portion 44 and allows the concave portion 39 on the other side in the lateral direction of the outer wall portion 33 to communicate with an outside. The blow-by-gas discharging port 45 is provided with a pollution control valve (PCV) 46, and is connected to a blow-by-gas supplying hose 47 through the PCV 46. Through these, the blow-by-gas is supplied to the inlet manifold 13 (refer to FIG. 1, too).

As shown in FIGS. 3, 5 through 9, the partition wall plate 31 is provided in the cover member 30 for covering the lowest concave portion 41, and divides the closed space 36 into an inner chamber 48 and an outer chamber 49. A shape of the outer peripheral edge of the partition wall plate 31 corresponds to a shape of the step portion 40. An attaching groove 50 is formed in the inner surface of the partition wall plate 31 over the whole peripheral edge thereof. A plurality of attaching portions 51 (attaching holes) corresponding to the attaching projections 43 is formed in the inner surface of the partition wall plate 31 at the outer peripheral side of the attaching groove 50.

In the partition wall plate 31, an outer sidewall of the attaching groove 50 fits in the attaching groove 42 of the step portion 40, and an inner sidewall of the attaching groove 42 of the step portion 40 fits in the attaching groove 50 (faucet joint fitting structure). The respective attaching projections 43 and the respective attaching portions 51 are fixed with a stopper (push nut, press fastener and the like) in a fitted-in state. Accordingly, the outer chamber 49 is formed between the outer wall portion 33 and the partition wall plate 31 with a large width in the lateral direction (in the longitudinal direction of the cylinder block 2 (the engine main portion 1)) of the cover member 30, and with a small thickness (for example, approximately 4 mm) in a thickness direction (in the width direction of the cylinder block 2) of the cover member 30. The air tightness of the outer chamber 49 is secured with respect to the outside.

The partition wall plate 31 is also curved in a wave shape corresponding to the outer wall portion 33. Accordingly, the outer chamber 49 extends from a lower side to an upper side with a constant narrow space in the thickness direction (width direction of the cylinder block 2) of the cover member 30. The space of the outer chamber 49 is continuously curved along the wave shape of the outer wall portion 33 and partition wall plate 31 (refer to FIGS. 3, 5 and 6).

A dividing wall portion 53 with a band shape is formed integrally with the partition wall plate 31, and is formed of a material same as that of the partition wall plate 31. The dividing wall portion 53 projects from a plate surface of the partition wall plate 31, and extends across the partition wall plate 31 in a lateral direction. The dividing wall portion 53 is inclined downwardly from the other side of the cover member 30 in the lateral direction (left side in FIG. 8) to one side thereof (right side in FIG. 8), and corresponds to the dividing wall portion 26 of the frame member 23. When the cover member 30 is attached to the frame member 23 in a state that the partition wall plate 31 is attached to the cover member 30, a forward end surface of the dividing wall portion 53 abuts against a forward end surface of the dividing wall portion 26 in the frame member 23. Accordingly, the dividing wall portions 53 and 26 form one dividing wall to thereby divide the inner chamber 48 into two vertical chambers, i.e. the first inner chamber 54 and the second inner chamber 55 above the first inner chamber 54.

A drain hole 56 is formed at the lowest position of the dividing wall portion 53. The drain hole 56 is formed of a small hole so that oil flowing along the upper surface of the dividing wall portion 53 is discharged to the first inner chamber 54 therethrough. Incidentally, the dividing wall portion 53 is also formed integrally with a plurality of ribs 57 to thereby support the dividing wall portion 53.

As shown in FIGS. 3, 5, 6, 8 and 9, the partition wall plate 31 is provided with a blow-by-gas inlet 58 and a blow-by-gas vent 59. The blow-by-gas inlet 58 is located below the dividing wall portion 53 at a position upwardly away from the bottom surface of the outer chamber 49, so that the first inner chamber 54 communicates with the outer chamber 49. The blow-by-gas inlet 58 has an elongated shape with a large area as compared with the small drain hole 56, and is arranged such that a long axis thereof extends in the lateral direction of the cover member 30. The blow-by-gas vent 59 is positioned above the partition wall plate 31 at an upper side of the dividing wall portion 53. The blow-by-gas vent 59 has an elongated shape with an area larger than that of the blow-by-gas inlet 58. The blow-by-gas vent 59 allows the second inner chamber 55 to communicate with the outer chamber 49.

The partition wall plate 31 is provided with a drain hole 60 below the dividing wall portion 53 as an opening for discharging oil. A cylindrical member 61 is provided along a peripheral edge of the drain hole 60, and projects from the partition wall plate 31 toward the first inner chamber. The drain hole 60 allows the first inner chamber 54 to communicate with the lower portion of the outer chamber 49. Accordingly, similar to the Borda's mouthpiece, the cylindrical member 61 increases a degree of contraction of the gas flow, thereby increasing the loss head. As a result, the blow-by-gas is preferentially introduced into the outer chamber 49 rather than the drain hole 60, and the oil does not block the drain hole 60.

The drain hole 60 is arranged next to the blow-by-gas inlet 58 in the lateral direction of the cover member 30. The drain hole 60 is opened to face a portion of the partition wall plate 31 projecting toward outside in the thickness direction (outside in the width direction of the cylinder block 2) of the cover member 30 with the amount of the projection increasing downwardly in the outer chamber 49.

In the present embodiment, as shown in FIG. 1, fresh air introducing paths 62 pass through the cylinder head 6 and the cylinder block 2. One end of fresh air introducing path 62 communicates with the cylinder head cover 7 for introducing fresh air through a by-path pipe 63, and the other end thereof communicates with the crankcase 5. Accordingly, as indicated by hidden lines with arrows, the fresh air flows into the first inner chamber 54 through the blow-by-gas inlet 29.

Figure 12:
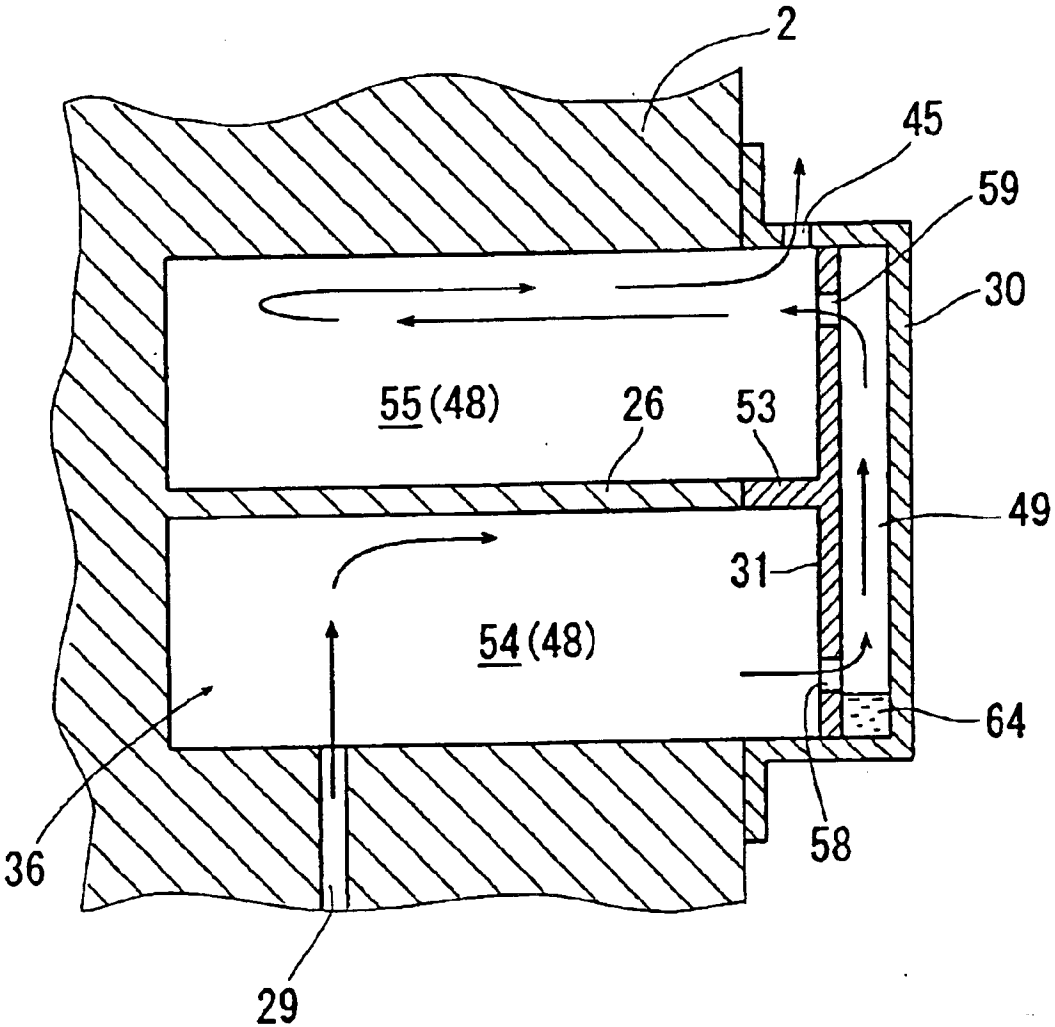
FIG. 12 is a schematic view for explaining a concept of the present invention.

In the oil separating portion 20 as described above, as schematically shown in FIG. 12, the blow-by-gas containing the oil mists introduced from the crankcase is sequentially subjected to the oil separating process in the first inner chamber 54, the outer chamber 49 and the second inner chamber 55. In other ward, three oil separating processing portions are arranged in a limited space.

More specifically, as shown in FIG. 3, the blow-by-gas containing the oil mists flows into the first inner chamber 54 from the crankcase 5 through the blow-by-gas inlet 29 (indicated by solid lines with arrows). The blow-by-gas collides with the dividing wall portion 26 and the dividing wall portion 53 to shift the flowing direction, so that the oil mists contained in the blow-by-gas do not follow the blow-by-gas, and are separated. Further, the oil mists themselves are agglomerated and are returned to the crankcase 5 (oil pan) through the blow-by-gas inlet 29 due to the gravitation. After the blow-by-gas changes the flow direction at the dividing wall portions 26 and 53, the oil mists are further separated due to the gravitation effect while the blow-by-gas flows from the dividing wall portions 26 and 53 to the blow-by-gas inlet 58.

Figure 10:
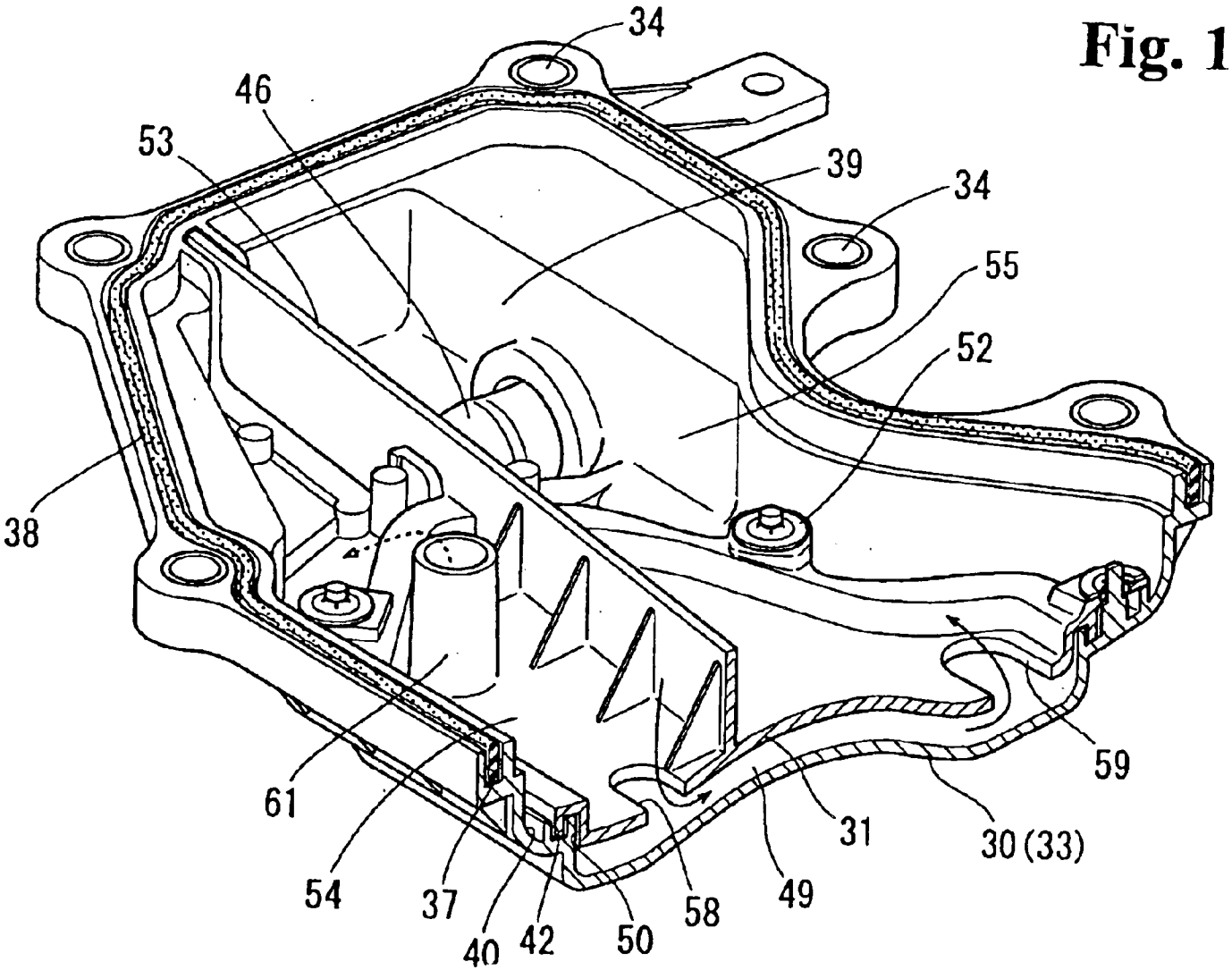
FIG. 10 is a partially broken perspective view showing a flow of blow-by-gas in the oil separating unit of the embodiment.

Then, the blow-by-gas is introduced into the outer chamber 49 from the first inner chamber 54 through the blow-by-gas inlet 58. As shown in FIG. 10, when the blow-by-gas is introduced, the blow-by-gas collides with the outer wall portion 33 to shift the flow direction upward, so that the oil mists are separated from the blow-by-gas at this point.

After the flow direction is changed at the blow-by-gas inlet 58, the blow-by-gas flows upwardly in the outer chamber 49. The outer chamber 49 is disposed at the outer side in the thickness direction of the cylinder block, and has the narrow space in the width direction of the cylinder block 2 (flat shape). Accordingly, when the blow-by-gas flows through the outer chamber 49, the blow-by-gas containing the oil mists is effectively cooled down through the outer wall portion 33. As a result, it is possible to facilitate the agglomeration of the oil mists contained in the blow-by-gas, so that the oil 64 is collected at the lower portion of the outer chamber 49. In this case, the outer wall portion 33 has the curved wave shape with a large cooling area, thereby further increasing the agglomeration effect of the oil mists.

The outer chamber 49 has the curved shape upwardly, and the oil mists stick to the inner surfaces of the partition wall plate 31 and the outer wall portion 33 to thereby wet the inner surfaces thereof. Accordingly, the oil mists contained in the newly coming blow-by-gas stick the wet inner surfaces. Due to the continuous curved shape of the outer chamber 49, similar to the baffle plates, it is possible to facilitate the agglomeration and the separation of the oil mists.

Further, the oil mists become dense in the outer chamber 49 with the narrow space in the width direction of the cylinder block, so that the oil mists are agglomerated to become oil particles with larger diameters. When the oil particles grow larger, it is easy to separate the oil from the blow-by-gas. The outer chamber 49 has the width in the longitudinal direction of the cylinder block decreasing upwardly (refer to FIG. 8), thereby making the separation more effective.

Additionally, through the oil separation as described above, oil is gradually collected at the lower side in the outer chamber 49. When the oil level reaches above the blow-by-gas inlet 58 and the drain hole 60, oil 64 is discharged from the drain hole 60 into the first inner chamber 54. Thereafter, oil 64 is retained up to lower edges of the blow-by-gas inlet 58 and the drain hole 60. In this state, if the blow-by-gas is introduced from the blow-by-gas inlet 58, the oil mists contained in the blow-by-gas contact oil below the blow-by-gas inlet 58. Accordingly, the oil mists are absorbed (aggregated) in the oil, so that the oil mists are further separated from the blow-by-gas. In this case, the blow-by-gas inlet 58 is arranged such that the long axis thereof is aligned with the lateral direction of the cover member 30, thereby increasing a contact surface between the blow-by-gas and the oil and facilitating the absorption of the oil mists.

Figure 11:
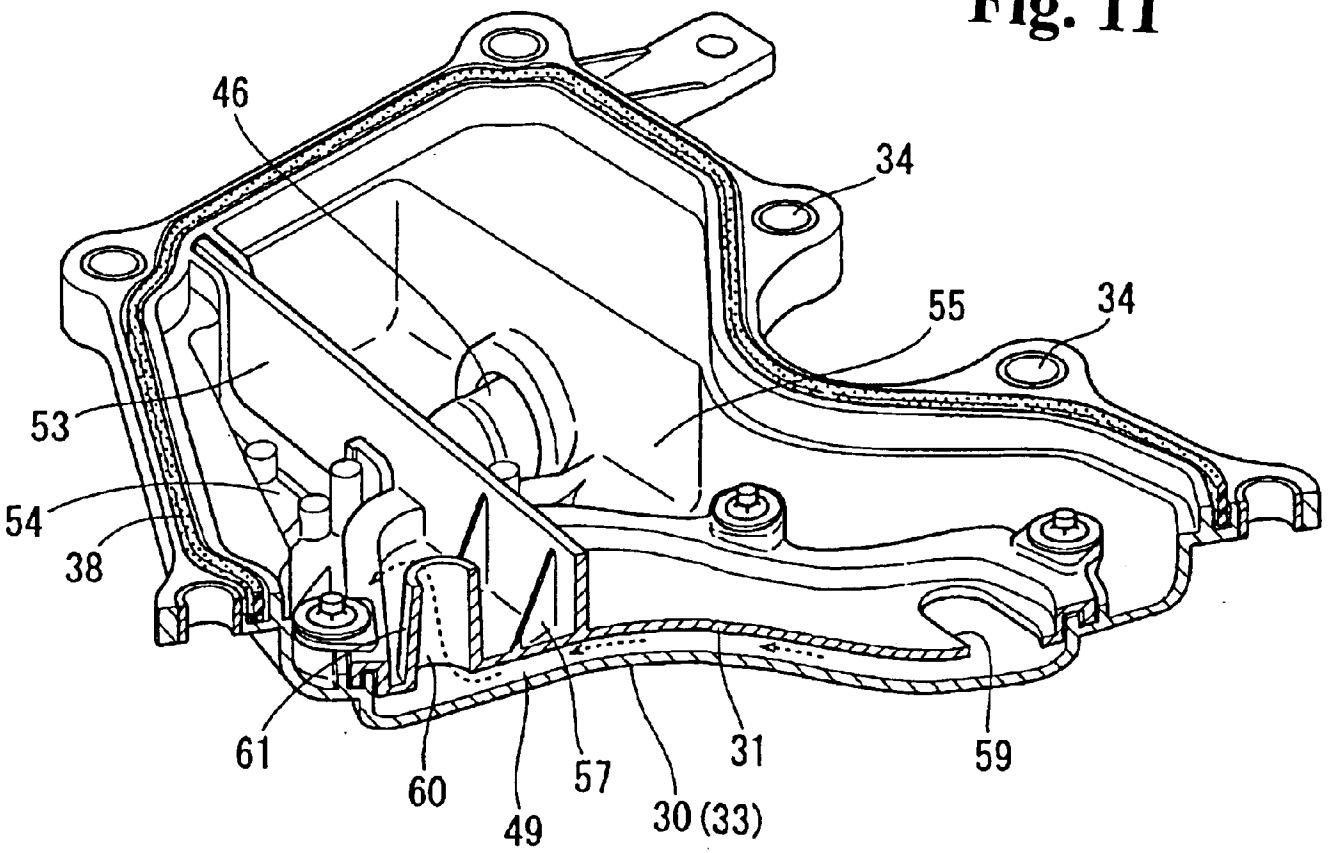
FIG. 11 is a partially broken perspective view for explaining collection of oil in the oil separating unit of the embodiment.

When oil exceeds the lower edges of the blow-by-gas inlet 58 and the drain hole 60, oil above the lower edges is discharged, i.e. overflowed, into the inner chamber 54 through the drain hole. Oil separated at the upper side of the outer chamber 49 falls along the inner surface of the partition wall plate 31. The drain hole 60 is opened at the portion of the partition wall plate 31 extending outwardly in the width direction of the cylinder block 2 as the location comes downwardly. As a result, oil is smoothly guided to the drain hole 60 as shown by hidden lines with arrows in FIGS. 6 and 11.

As described above, due to the multiple separation processes in the outer chamber 49, it is possible to effectively separate the oil mists from the blow-by-gas.

Then, as shown in FIG. 3, the blow-by-gas is introduced into the second inner chamber 55 from the outer chamber 49 through the blow-by-gas vent 59. The blow-by-gas is slowed due to the chamber (space) effect, and the oil mists are separated due to the gravitation, and are agglomerated into oil. Oil is guided along the upper surfaces of the dividing wall portions 26 and 53, and is finally discharged to the first inner chamber 54 through the drain hole 56 in the dividing wall portion 53. The blow-by-gas with the oil mists removed is supplied to an inlet manifold 13 from the blow-by-gas discharging port 45 through the PCV valve 46 and the blow-by-gas supplying hose 47.

As described above, the oil separating portion 20 includes the first inner chamber 54, the outer chamber 49 and the second inner chamber 55, i.e. three oil separating process areas, thereby improving the oil separation performance.

While the invention has been explained with reference to the specific embodiments of the invention, the explanation is illustrative and the invention is limited only by the appended claims.

What is claimed is:

1. An oil separating mechanism formed at a concave portion, comprising:

a cover member to be attached to the concave portion for forming a closed space, a partition wall disposed inside the closed space for dividing the closed space into an inner chamber between the partition wall and the concave portion, and an outer chamber between the partition wall and the cover member, a dividing wall extending from the partition wall toward the concave portion for dividing the inner chamber into a first inner chamber and a second inner chamber, a first gas port provided in the partition wall for communicating the first inner chamber with the outer chamber, and a second gas port provided in the partition wall for communicating the outer chamber with the second inner chamber so that gas introduced into the first inner chamber flows to the second inner chamber through the first gas port, the outer chamber and second gas port to remove oil contained in the gas.

2. An oil separating mechanism according to claim 1, further comprising a gas inlet provided in the first inner chamber for introducing the gas into the first inner chamber, and a gas outlet provided in the second inner chamber for discharging the gas therefrom.

3. An oil separating mechanism according to claim 2, wherein said cover member is formed in a curved shape.

4. An oil separating mechanism according to claim 2, wherein said cover member protrudes outwardly to include a recess portion therein, said partition wall being disposed in the recess portion for forming the outer chamber in the recess portion.

5. An oil separating mechanism according to claim 2, wherein said partition wall and said cover member are formed in curved shapes so that the outer chamber from the first gas port to the second gas port has a curved shape.

6. An oil separating mechanism according to claim 2, wherein said dividing wall divides the inner chamber such that the first inner chamber is situated below the second inner chamber, said first gas port being situated below the second gas port.

7. An oil separating mechanism according to claim 2, wherein said partition wall includes a portion protruding outwardly as the partition wall extends downwardly, said first gas port being formed in said portion of the partition wall.

8. An oil separating mechanism according to claim 2, wherein said partition wall is disposed inside the cover member at one side thereof, said outer chamber being disposed at one side in a lateral direction of the cover member and said gas outlet being situated in an upper part of the cover member at the other side thereof.

9. An oil separating mechanism according to claim 2, wherein said partition wall is disposed inside the cover member at one side thereof such that the partition wall is shortened as a position of the partition wall is located upward to thereby form the outer chamber to become narrower as a position of the outer chamber is located upwardly.

10. An oil separating mechanism according to claim 2, wherein said partition wall is further provided with an oil discharging port at a position below the dividing wall, said oil discharging port having a cylindrical member extending from a peripheral edge of the oil discharging port toward the concave portion.

11. An oil separating mechanism according to claim 10, wherein said partition wall includes a portion protruding outwardly as the partition wall extends downwardly, said oil discharging port being formed in the portion of the partition wall.

12. An oil separating mechanism according to claim 2, wherein said gas inlet is provided at a lower portion of the first inner chamber.

13. An oil separating mechanism according to claim 2, wherein said first gas port is provided in the partition wall at a position away from a bottom of the outer chamber.

14. An oil separating mechanism according to claim 2, wherein said first gas port is formed in a long hole, shape extending horizontally.

15. An oil separating mechanism according to claim 2, wherein said dividing wall extends from the partition wall such that one side of the dividing wall is situated lower than the other side of the dividing wall, and a drain hole communicating the first inner chamber with the second inner chamber is formed in the dividing wall at a position closer to the one side of the dividing wall.

16. An oil separating unit comprising a cylinder block having said concave portion at one side thereof, and said oil separating mechanism according to claim 1, said cover member being attached to the cylinder block so that the dividing wall contacts the cylinder block to separate the concave portion into the first and second inner chambers.

17. An oil separating unit according to claim 16, wherein said cover member protrudes outwardly to include a recess portion therein, said partition wall being disposed in the recess portion for forming the outer chamber in the recess portion, said dividing wall abutting against a portion extending from the cylinder block in the recess.

18. An oil separating unit according to claim 16, further comprising a gas inlet provided in the cylinder block to communicate with the first inner chamber for introducing the gas into the first inner chamber, and a gas outlet provided in the second inner chamber for discharging the gas therefrom.

* * * * *